US008348705B2

(12) United States Patent
Dickenson

(10) Patent No.: US 8,348,705 B2
(45) Date of Patent: Jan. 8, 2013

(54) ELECTRICAL CONNECTOR

(75) Inventor: Daniel James Dickenson, Libertyville, IL (US)

(73) Assignee: Termax Corporation, Lake Zurich, IL (US)

( * ) Notice: Subject to any disclaimer, the term of this patent is extended or adjusted under 35 U.S.C. 154(b) by 0 days.

(21) Appl. No.: 12/348,308

(22) Filed: Jan. 4, 2009

(65) Prior Publication Data

US 2010/0173515 A1 Jul. 8, 2010

(51) Int. Cl.
*H01R 11/09* (2006.01)

(52) U.S. Cl. ..... 439/784; 439/790; 439/805; 174/87

(58) Field of Classification Search ..... 174/87; 439/784, 790, 805
See application file for complete search history.

(56) References Cited

U.S. PATENT DOCUMENTS 4,029,383 A 6/1977 Harding et al.
4,163,868 A * 8/1979 Stotts ..... 174/87
4,295,004 A * 10/1981 Dauser, Jr. ..... 174/87
4,318,580 A * 3/1982 Fleisher et al. ..... 439/403
4,446,332 A 5/1984 Dauser, Jr.
4,473,715 A * 9/1984 Beinhaur et al. ..... 174/87
5,099,089 A 3/1992 Zan
5,113,037 A * 5/1992 King et al. ..... 174/87
5,132,494 A * 7/1992 Burton et al. ..... 174/87
5,179,253 A 1/1993 Munniksma et al.
5,446,241 A * 8/1995 Mackaness et al. ..... 174/91
5,585,601 A * 12/1996 Adler ..... 174/87
5,847,320 A 12/1998 Fisher
5,922,994 A 7/1999 Robinson, Sr. et al.
5,975,938 A 11/1999 Libby
6,953,373 B1 * 10/2005 Vos ..... 439/784

* cited by examiner

*Primary Examiner* — Truc Nguyen
(74) *Attorney, Agent, or Firm* — CGIP Law

(57) ABSTRACT

A pivoting electrical connector includes a base and housing. The base has a cavity and base partitions to receive at least two conductors. The housing is operative to pivotally connect to said base and is adapted to rotate about an axis of rotation to allow insertion of one or more conductors into said cavity and to twist the conductors into electrical contact when the housing is pivoted. The electrical connector is operative to twist one or more conductors safely within the housing.

20 Claims, 10 Drawing Sheets

ELECTRICAL CONNECTOR

FIELD OF THE INVENTION

The invention relates generally to electrical connectors, and more particularly to an electrical connector operable to twist conductors into electrical contact.

BACKGROUND OF THE INVENTION

Once way to connect two or more wires is to strip the insulation of each wire and crimp, twist or strand the wires together. A number of devices and fasteners are currently available for fastening electrical conductors. Twist-on connectors, also known as spring connectors, typically comprise helically coiled wires for receiving twisted conductor wire ends. As the wire ends are inserted, the coil spring expands slightly as the twisted wire ends are inserted. One disadvantage in nearly all conventional twist on connectors is the limited range of wire diameters the connector can accommodate. Another disadvantage is that contact between the conductors is made before the conductors are inserted into the connector, thus exposing the technician to the possibility of sparking, electrical shock, short circuit or other electrical hazard.

DETAILED DESCRIPTION OF THE PREFERRED EMBODIMENTS

Figure 1:
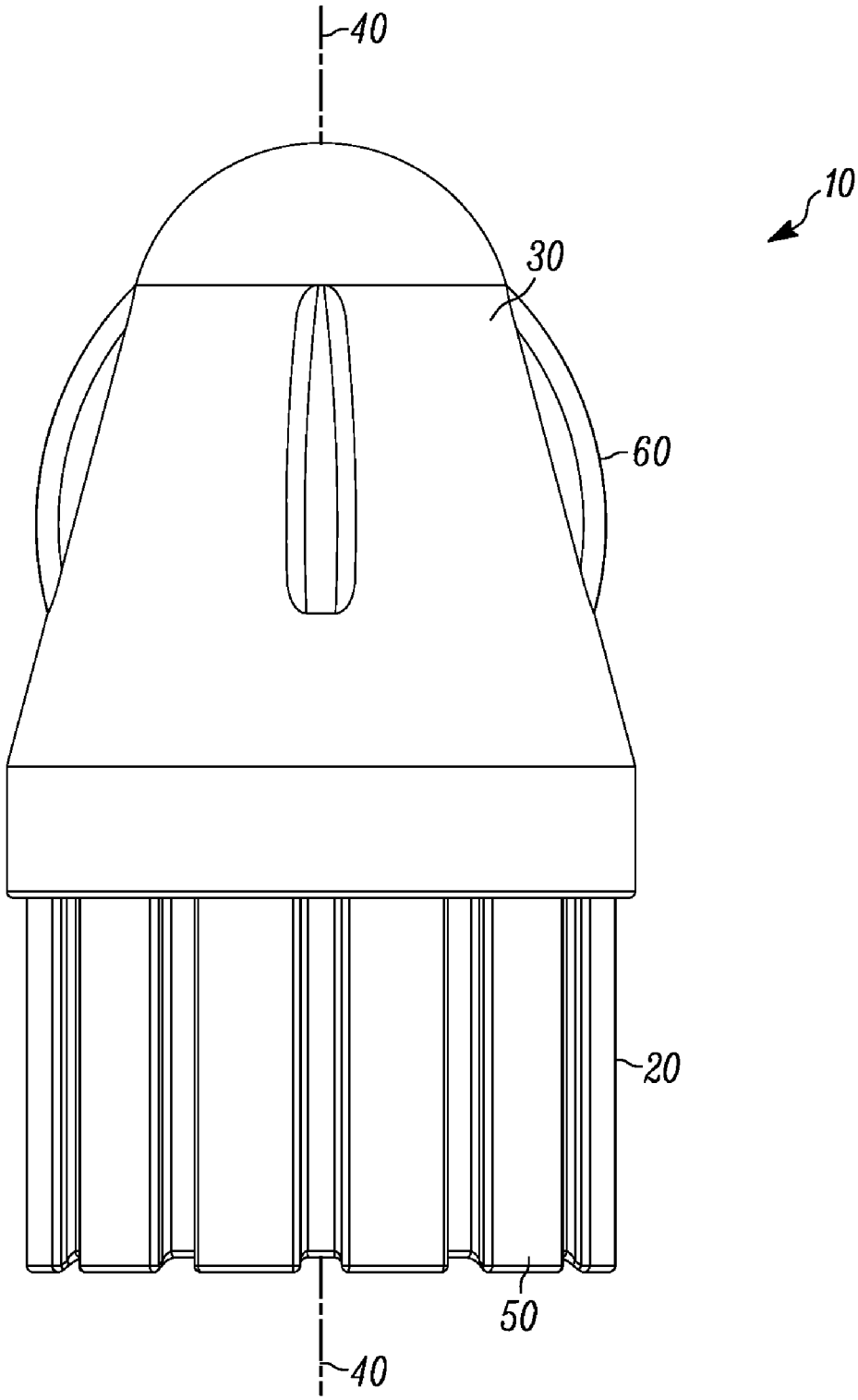
FIG. 1 is a side view of an electrical connector according to one embodiment.

A pivoting electrical connector includes a base and housing. The base has a cavity and base partitions to receive one or more conductors. The housing is operative to pivotally connect to the base and is adapted to rotate about an axis of rotation to allow insertion of the conductors into said cavity and to twist the conductors into electrical contact when the housing is pivoted. The electrical connector is operative to twist one or more conductors safely within the housing.

Among other advantages, the electrical connector relatively easily and safely facilitates connecting one or more conductors. For example, since the conductors are twisted within the housing, and above the base, a stronger mechanical and electrical connection may be created. Also, the twisting of the housing and base is much easier and safer because of improved mechanical leverage and also because contact is made with the base and housing rather than with the conductors. Since the conductors do not connect until the conductors are inserted in the electrical connector, the electrical connector reduces or eliminates exposing the technician to the possibility of sparking, electrical shock, short circuit or other electrical hazard. The electrical connector provides excellent engagement in a faster way, while minimizing the risks of electrical hazard.

An optional wing and gripper ridge permits relatively easy twisting of the electrical connector while providing a relatively high level of resistance from un-wrapping even if the conductors are pulled apart. For example, the base partitions may have pinch ends to prevent withdrawal of the conductor to further resist un-wrapping. Assembly of the electrical connector requires a relatively low level of insertion force compared to the extraction force, although the base and housing may be removed. Further, the relatively easy twisting of the housing provides many ergonomic advantages. For example, the relatively low level of twisting force is particularly advantageous for crafts-personnel, such as technicians and assembly line operators who repetitively twist connectors. The relatively low level of twisting force required for making connections may result in fewer injuries to the crafts-personnel, including injuries related to repetitive stress syndrome. Further since the electrical connector can adapt to different sizes of conductors, a single or reduced number of electrical connectors may be used during assembly or constriction. Thus, confusion during assembly or wiring is reduced or eliminated since the same type electrical connector may be used for all connections. Thus, an electrician need not worry about selecting the electrical connector for different slot thicknesses.

The relatively high level of resistance to reverse twisting, characteristic of the electrical connector, securely couples conductors. Further, the electrical connector, along with the optional coiled wire and wrap wire continuously adapts to changes in environmental conditions such as flexing, vibration and thermal expansion. For example, the electrical connector may adapt to changes in thermal expansion, especially due to the differences in thermal expansion rates between dissimilar metals with respect to the conductors and/or between plastic components such as the base and housing. Yet another advantage is that the electrical connector is relatively easy to manufacture using relatively inexpensive manufacturing processes and materials. The use of the electrical connector decreases production costs, increases worker productivity and efficiency and decreases overall wiring costs. The electrical connector may also connect to insulated (along with the optional stripper blade) and/or metal conductors. The electrical connector may be made of anti-corrosive material such as plastic, rubber or treated metal to provide long reliable service life.

FIG. 1 is a side view of an electrical connector 10 comprising a base 20 and a housing 30 according to one embodiment. The base 20 is operative to rotate or twist about an axis 40. The base 20 and the housing 30 may be made a conductive material or alternatively of an insulating material depending on the requirements of the application. Optionally, the inside of housing 30 may have a conductive material to facilitate connection of the conductors. Twisting of the conductors together further creates a connection. A connection may be created even for different type, number and size of conductor wires. Optionally, the base 20 and the housing 30 may be made of: a translucent and transparent material in order to allow visual inspection and confirmation of the twisting and connection of the conductors and establishment of an electrical and mechanical connection. The electrical connector 10 may cap even a single conductor to insulate a stripped end of the conductor. For example, when rotated, the partitions would twist the single conductor to keep the electrical connector 10 attached to the single conductor.

According to one embodiment, the base 20 further includes gripper ridges 50. Optionally, the housing 30 further includes at least one wing 60. The gripper ridges 50 and wing(s) 60 may be formed by groves molded, cut or cast into the base 20 or housing 30 or any other suitable arrangement to permit gripping of the base 20 or housing 30 by hand, tool, machine, robot or other suitable manipulation device. Alternatively, the gripper ridges 50 and wing(s) 60 may be peaks formed on the base 20 or housing 30 by attaching grippers or wings made of any suitable material such as plastic, rubber, metal, wire, wood through molding, gluing, soldering, melting or any other suitable attachment method. Further, any suitable number of gripper ridges 50 and wing(s) 60 may be formed and any suitable shape or number may be used including any shape or number other than that shown in the figures. Gripper ridges 50 and wing(s) 60 may simply permit tightening with finger or tool.

Figure 2:
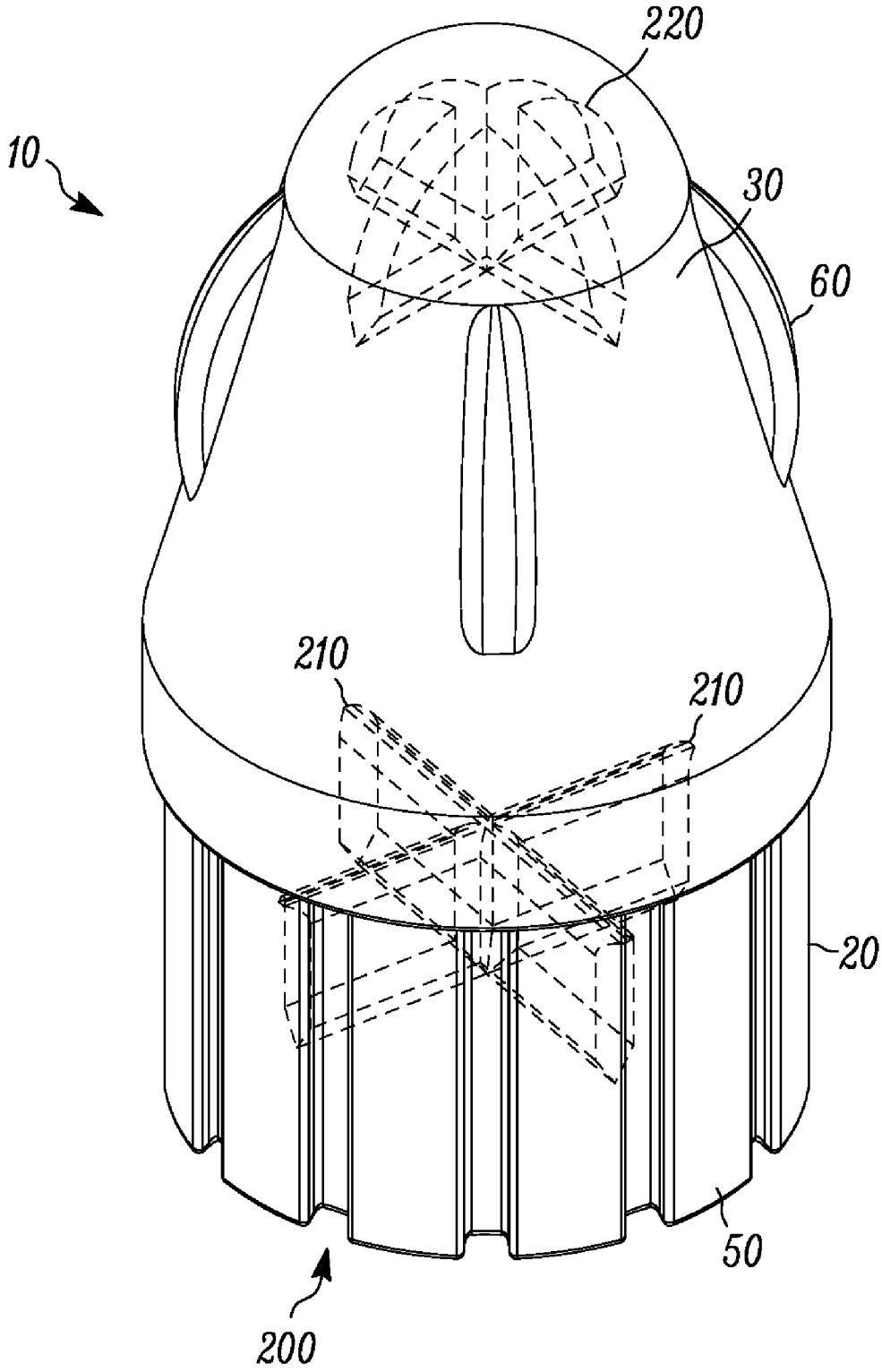
FIG. 2 is a perspective view of the electrical connector according to another embodiment.

FIG. 2 is a perspective view of a pivoting electrical connector 10 according to another embodiment. The base 20 has a cavity 200 and base partitions 210 to receive at least two conductors (not shown). The conductors may be solid, stranded and of any suitable gauge or diameter. The housing 30 is operative to pivotally connect to the base 20 and adapted to rotate about an axis of rotation 40 to allow insertion of the at least two conductors into the cavity 200 and to twist the conductors into electrical contact when the housing 30 is pivoted relative to the base 20. According to one embodiment, the housing 30 further includes one or more housing partitions 220 to twist the conductors into electrical contact when the housing 30 is pivoted relative to the base 20.

Figure 2A:
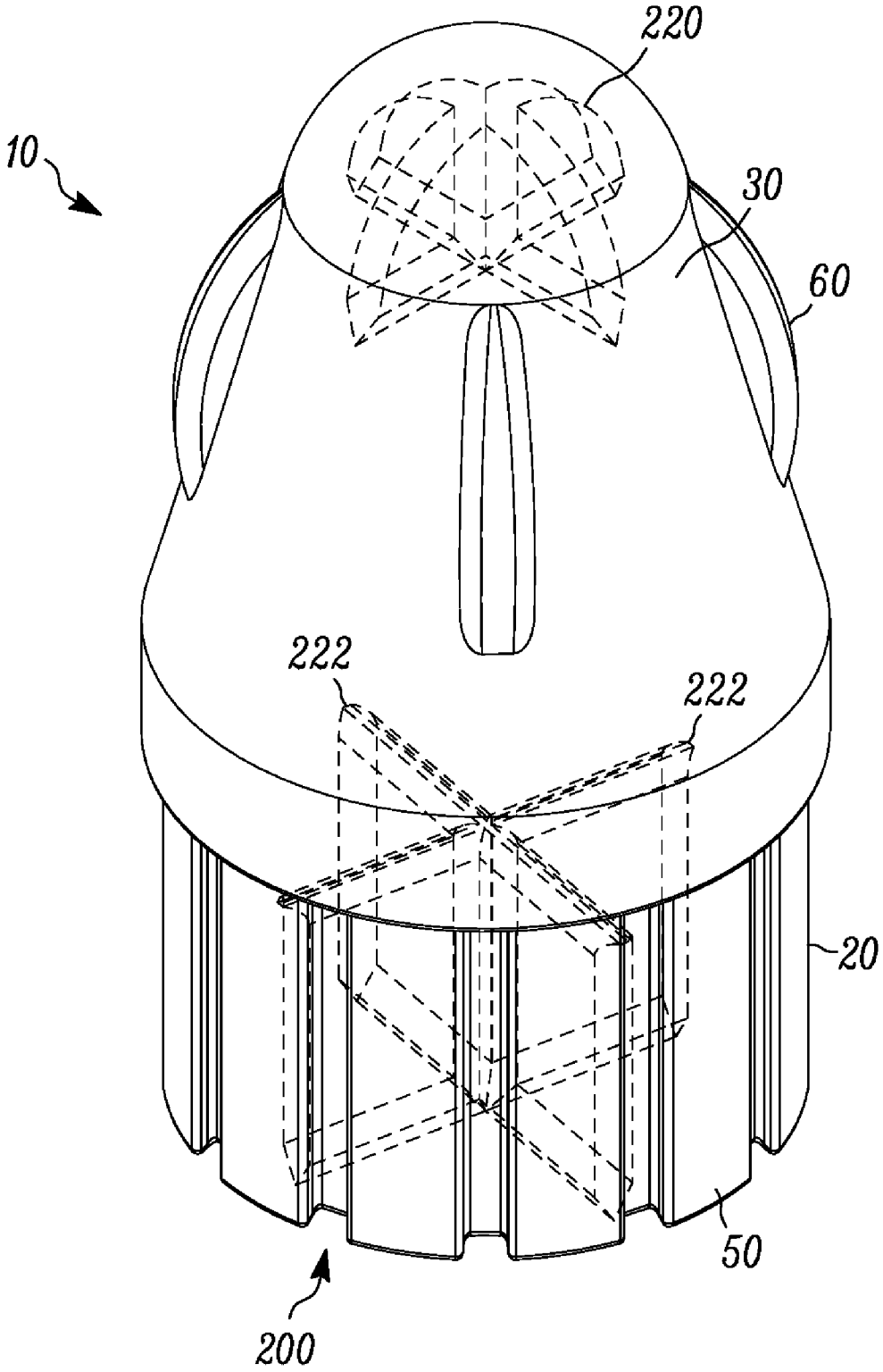
FIG. 2A is a perspective view of the electrical connector according to another embodiment.
Figure 2B:
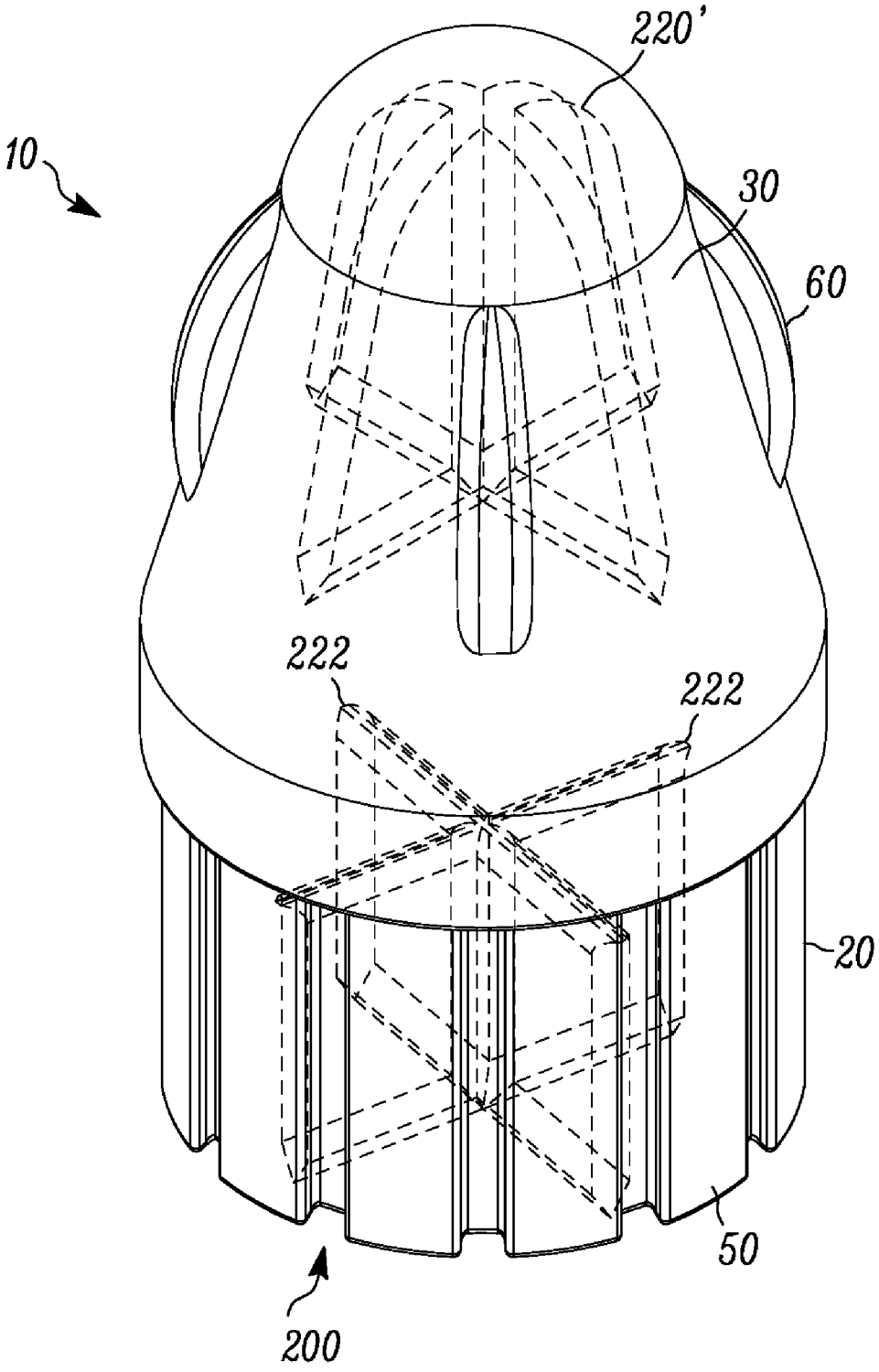
FIG. 2B is a perspective view of the electrical connector with partitions according to another embodiment.

The base partitions 210 may be any suitable shape, length or size. For example, the base partitions 210 may be longer as shown in the base partitions 222 shown in FIG. 2A. Similarly, FIG. 2B illustrates a longer housing partition 220'. The length of the base partitions 210, 222 and the housing partition 220, 220' may be set depending on the diameter of the wire conductor, the amount of room for the twisted wire conductor, and the amount of leverage or gripping of the conductor required.

Figure 3:
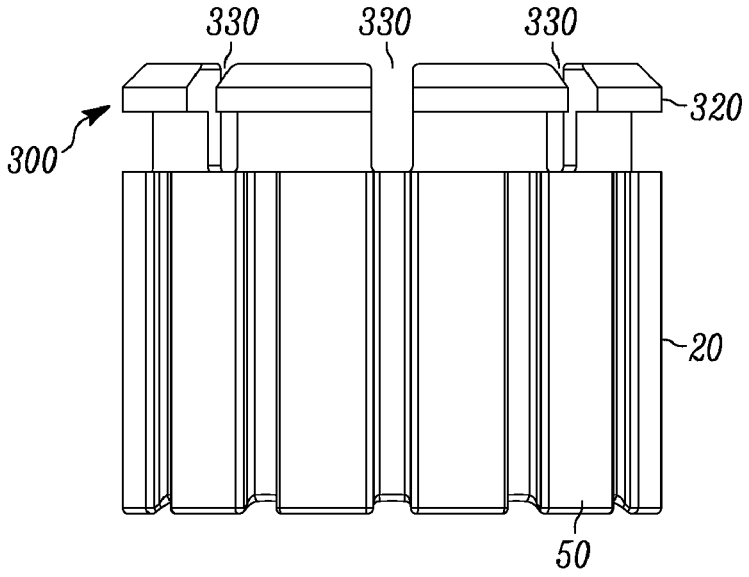
FIG. 3 is a side view of a base of the electrical connector with partitions according to one embodiment.
Figure 4:
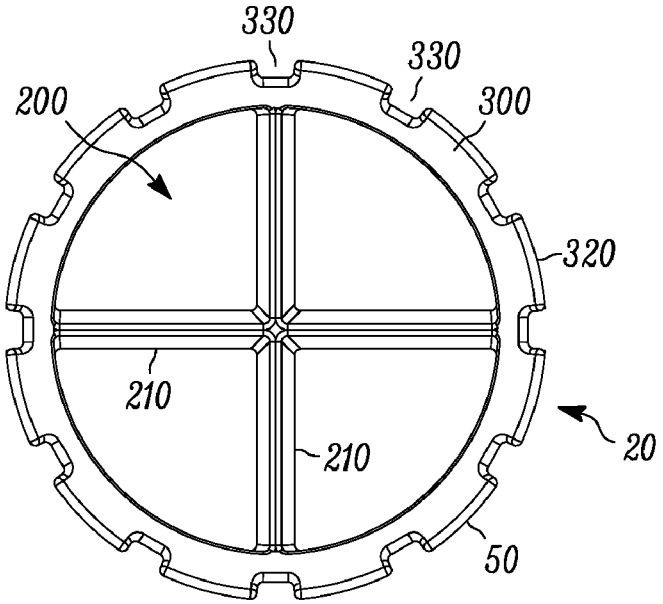
FIG. 4 is a top view of a base of the electrical connector according to one embodiment.

FIG. 3 is a side view of the base 20 of the electrical connector 10 according to one embodiment. FIG. 4 is a top view of the base 20 of the electrical connector 10 according to one embodiment. The base 20 further includes a base coupler 300. According to one embodiment, the base coupler 300 is a ridge 320 formed along the circumference of the edge of the base to operatively mate to the housing 30, as is described in further detail.

Figure 5:
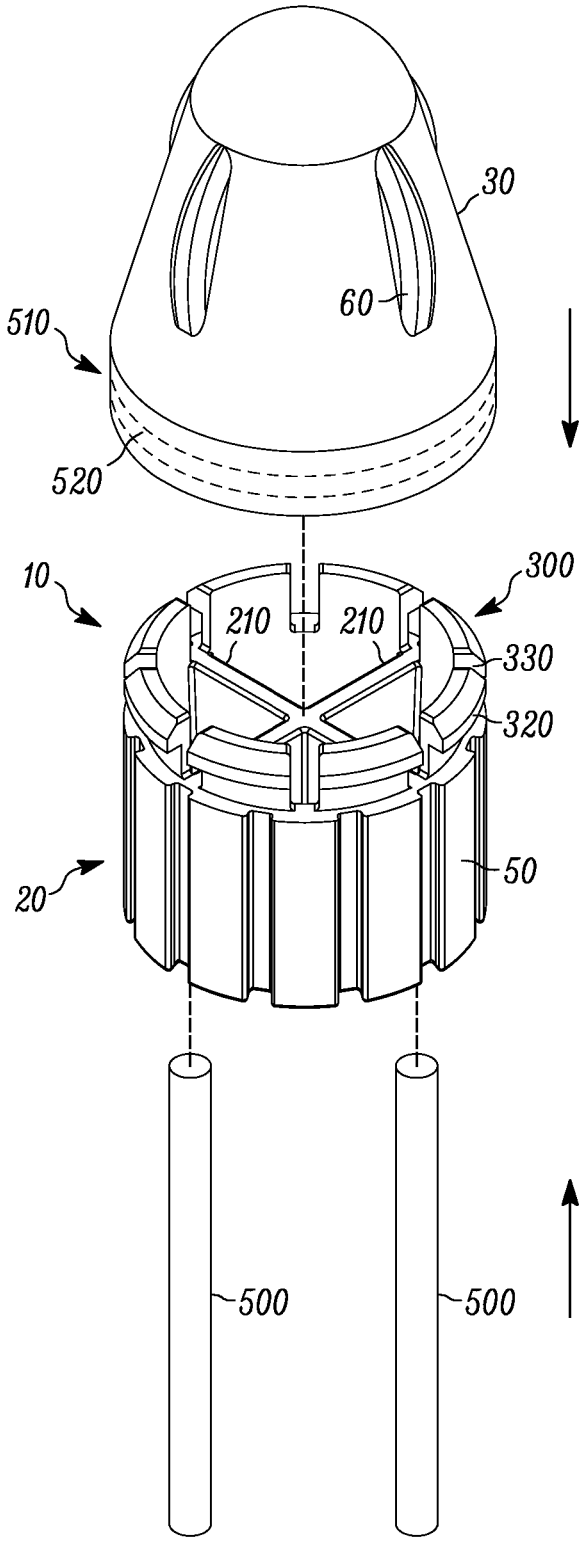
FIG. 5 is an exploded view of the electrical connector according to one embodiment.

FIG. 5 is an exploded view of the electrical connector 10 according to one embodiment. The housing 30 further includes a corresponding housing coupler 510 to pivotally connect the housing 30 to the base 20. Any suitable base coupler 300 and housing coupler 510 may be used such as screw and thread arrangement, a grommet and grove, bearing and channel or any other suitable coupling mechanism capable of permitting an appropriate amount of rotation. According to one embodiment, the base coupler 300 further includes a ridge 320 adapted to rotate about a grove 520 in the housing coupler 510. The ridge 320 and grove 520 permit insertion and optionally removal of the base 20 from the housing 30. Optionally, the ridge 320 includes one or more slots 330. The slots 330 permit additional flexibility in the ridge 320 to permit easy insertion of the base 20 into the housing 30 by simple compression or "snapping" in while providing a relatively high degree of extraction force.

Figure 6:
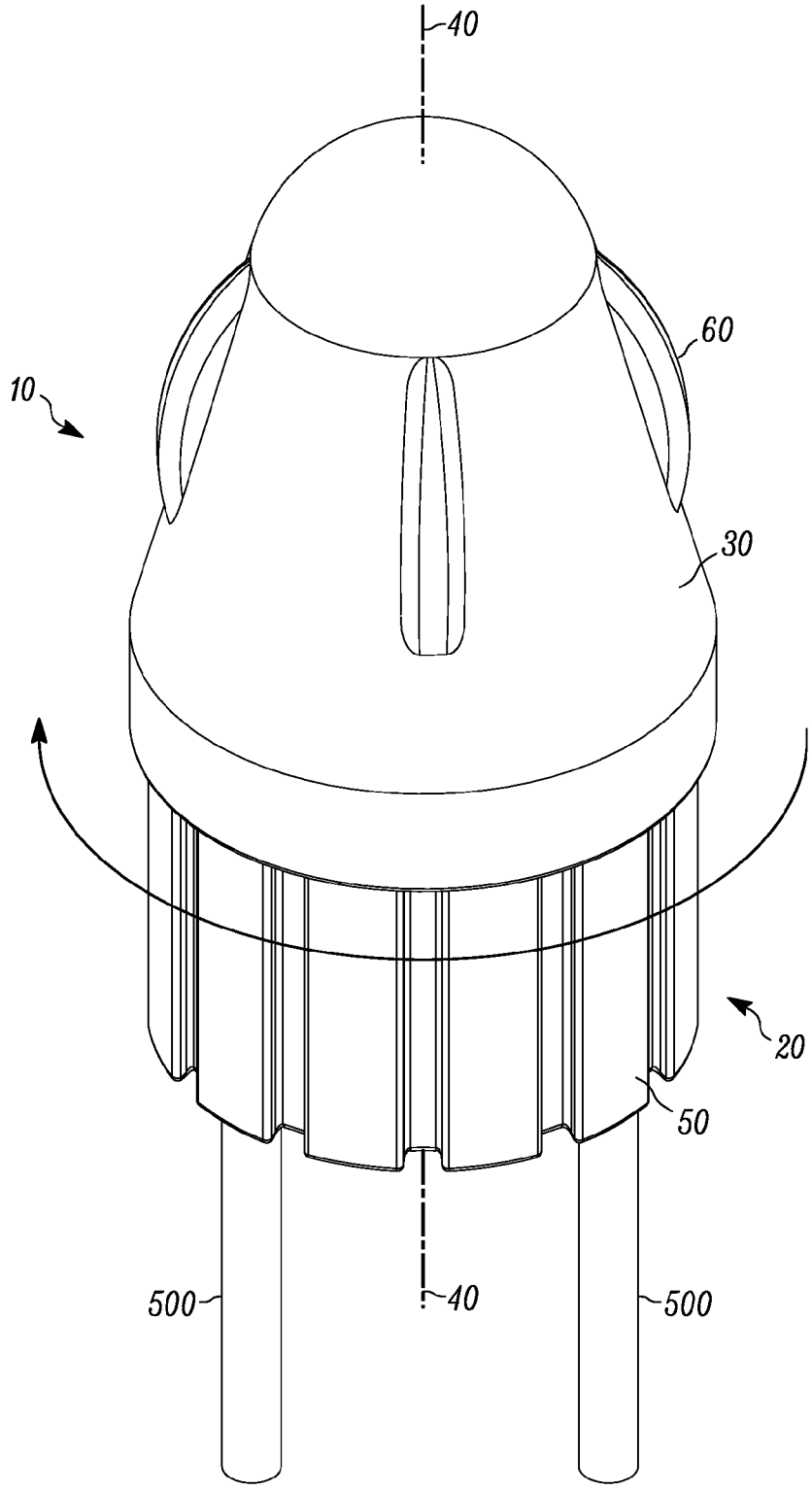
FIG. 6 is a perspective view of the electrical connector according to another embodiment.

FIG. 6 is a perspective view of the electrical connector according to another embodiment. This coupling between the base coupler 300 and housing coupler 510 allows the base 20 and housing 30 to rotate while coupled together. This rotation facilitates twisting on the conductors 500 to form an electrical and mechanical connection.

Figure 7:
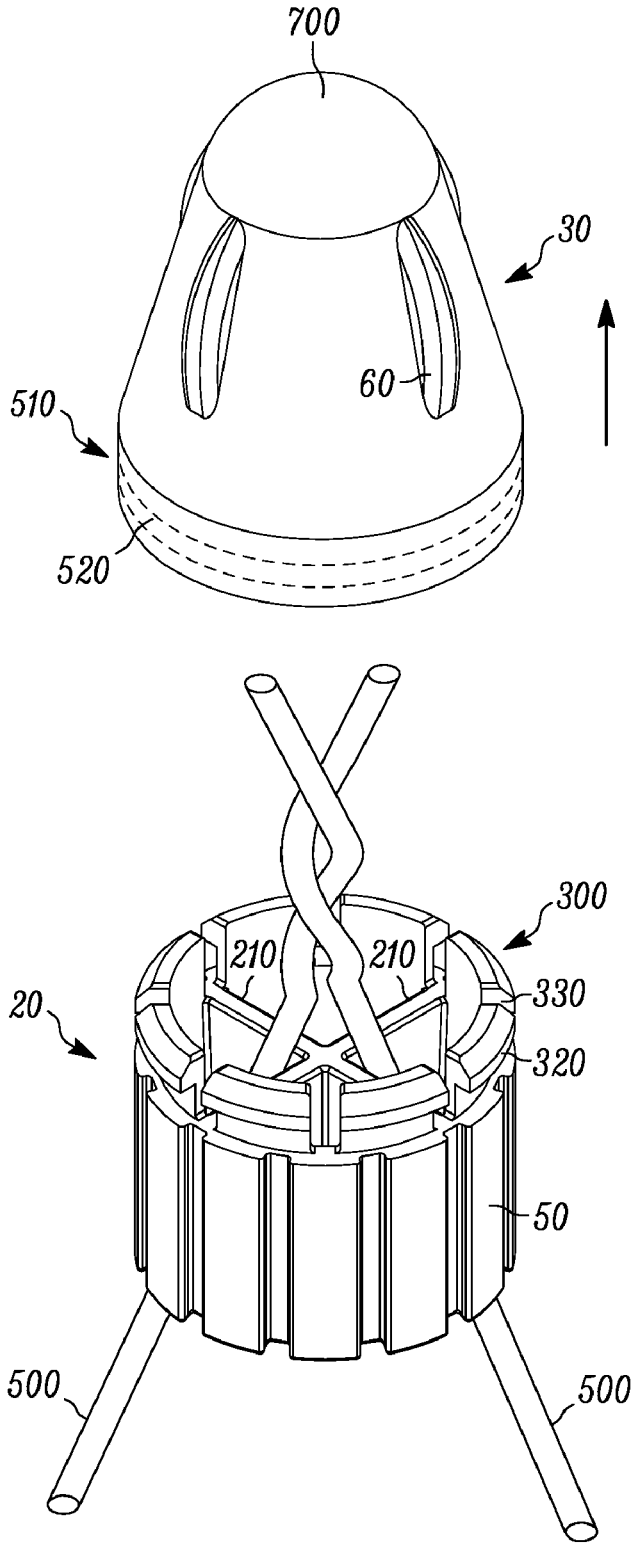
FIG. 7 is an exploded perspective view of the electrical connector showing the twisted conductors according to another embodiment.

FIG. 7 is an exploded view of the electrical connector showing the twisted conductors according to another embodiment. According to one embodiment, the housing 30 further includes the one or more housing partitions 220, 220' (shown in FIGS. 2, 2A, 2B) to twist the conductors 500 into electrical and mechanical contact when the housing 30 is pivoted relative to the base 20. For example, the conductors 500 are inserted at an open end of the base 30 and through the base partitions 210 and then through the housing partitions 220. As the conductors 500 are inserted, they may reach any suitable portion of the housing partitions 220, 220' to twist the conductors 500. Alternatively the conductors 500 are inserted until the conductors 500 reach then end of the housing partitions 220, 220' near the tip 700 of the housing 30. The housing partitions 220, 220' guide the conductors 500 to twist together when the housing 30 and base 20 are rotated about each other. Depending on the stiffness or malleability of the conductors 500, the housing partitions 220, 220' are sized and shaped accordingly to facilitate twisting of the conductors 500. For example, large gauge solid wire conductors 500 are relatively stiff and thus smaller sized housing partitions 220, 220' could be used and vise versa. Optionally, the housing partitions 220, 220' are tapered such that the edge of the housing partition 22 facing the conductors 500 are thinner or narrower toward the edge of the housing partitions 220, 220' and thicker further inside the housing 30. Thus, as the conductors 500 pass from the thinner part of the housing partitions 220, 220' the taper allows the conductors 500 to be easily inserted and to avoid blocking or jamming of the conductors 500 on the housing partitions 220, 220'.

The conductor 500 may optionally have insulation on the wires. According to one embodiment, the electrical connector 10 may connect two individually insulated conductors 500 with stripped ends. Alternatively, the electrical connector 10 may strip and connect an un-stripped end of insulated electrical cable having at least two individually insulated conductors 500 which are encased in an outer sheath. According to one embodiment, the base 20 or housing 30 may further include a pair of blade members capable of cutting through an outer insulation of said insulated conductors. For example, the housing partitions 220, 220' may include blade members to cut the outer insulation when the housing 30 is twisted relative to the base 20. The housing partitions 220, 220' may be electrically conducting blade members capable of penetrating the outer insulation of the conductors 50 and making an electrical connection.

Although four base partitions 210 and corresponding housing partitions 220, 220' are shown in the Figures as four quadrants, the base partitions 210 and corresponding housing partitions 220, 220' may be any suitable number of partitions and any suitable shape. For example, one or more housing partitions 220, 220' may be formed in the housing 30 and one or more base partitions 210 may be formed in the base 20. Further, the housing partitions 220, 220' and base partitions 210 may form the shape of: circles, triangles, rectangles, squares, ovals or any suitable shape.

Figure 8:
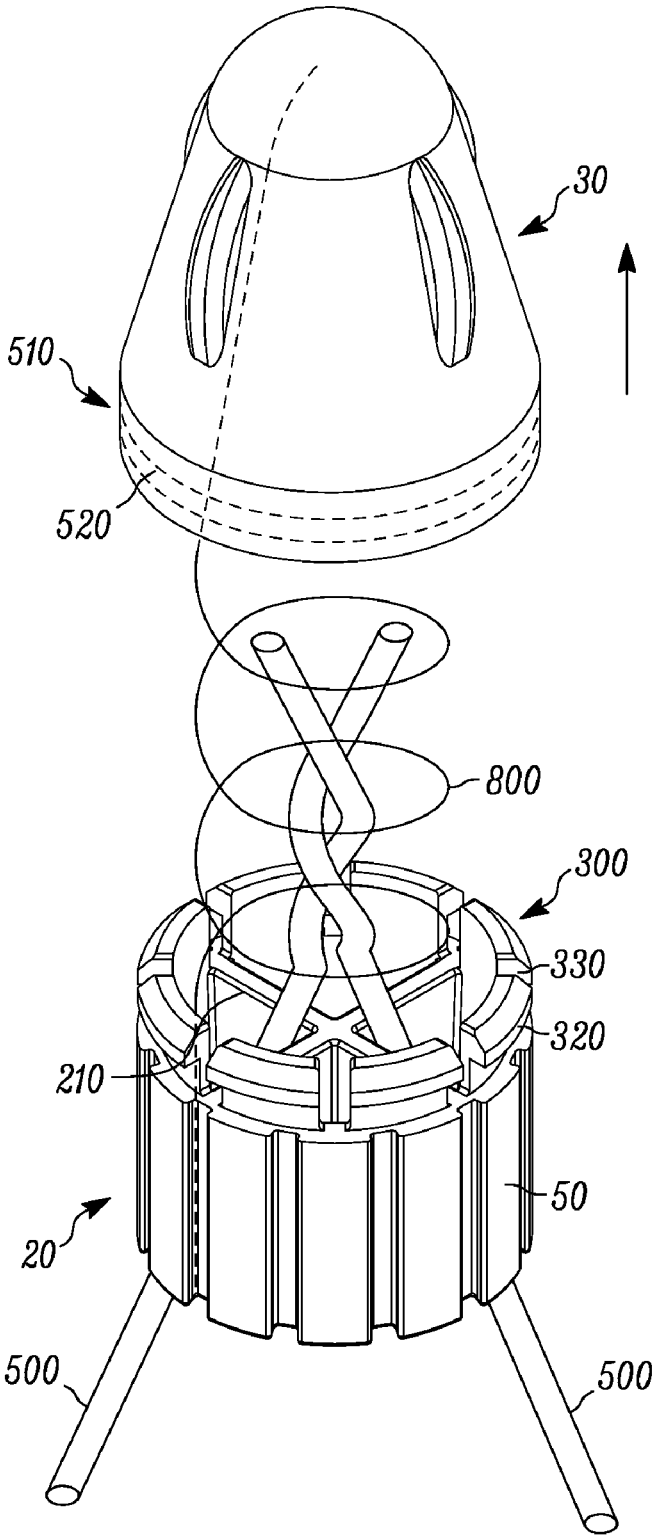
FIG. 8 is a perspective view of the electrical connector and a coiled wire according to another embodiment.

FIG. 8 is a perspective view of the electrical connector 10 and a coiled wire 800 according to another embodiment. For example, the coiled wire 800 receives the twisted conductor 500 wire ends and further tightens the electrical and mechanical connection as the base 20 and housing 30 are twisted together. Optionally, the coiled wire 800 may be capable of penetrating the insulation of un-stripped end of the conductors 500 to form an electrical and mechanical connection when twisted. Thus, the conductor ends need not be stripped of insulation.

Figure 9:
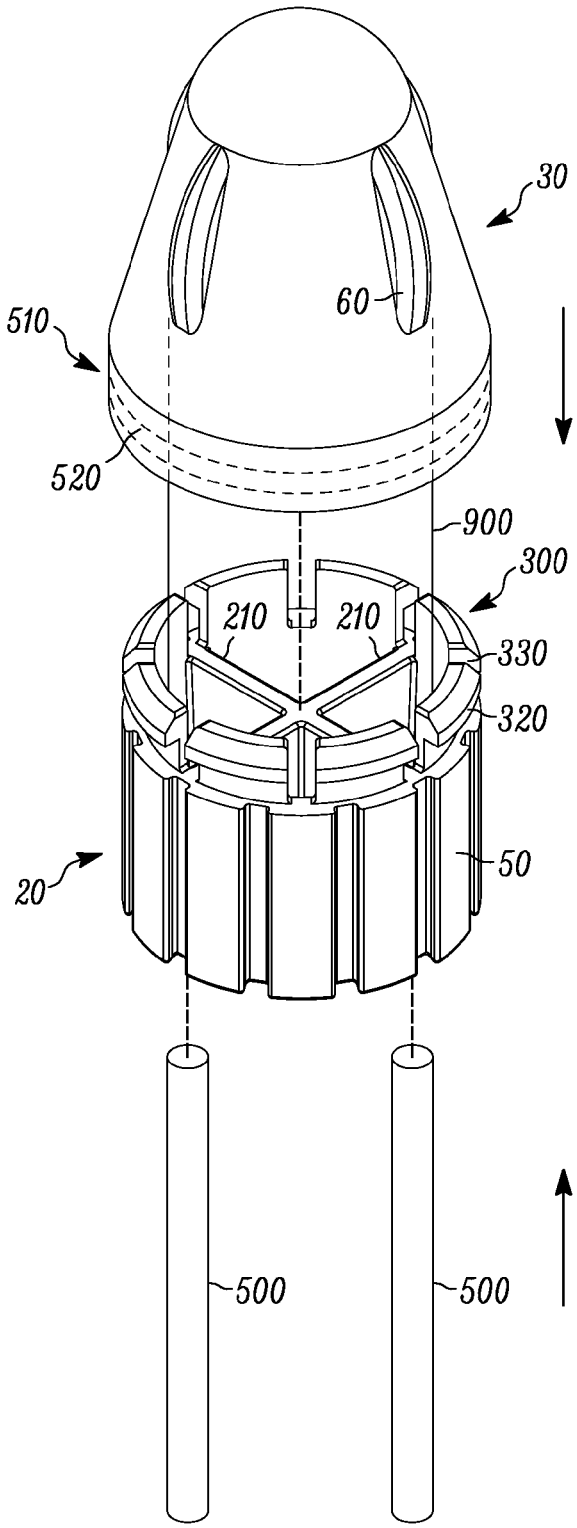
FIG. 9 is a perspective view of the electrical connector and wrap wire according to another embodiment.

FIG. 9 is a perspective view of the electrical connector 10 and wrap wire(s) 900 according to another embodiment. For example, the wrap wire(s) 900 receives the twisted conductor 500 wire ends and further tightens the electrical and mechanical connection as the base 20 and housing 30 are twisted together. Optionally, the coiled wire 900 may be capable of penetrating the insulation of un-stripped end of the conductors 500 to form an electrical and mechanical connection when twisted. Thus, the conductor ends need not be stripped of insulation.

According to one embodiment one or more electrical connectors 10 may be mounted or contained within an electrical terminal. The electrical terminal may be a connection block, an electrical box, a plate for mounting one or more electrical connectors 10 or any suitable mounting device.

Among other advantages, the electrical connector 10 relatively easily and safely facilitates connecting one or more conductors 500. For example, since the conductors 500 are twisted within the housing 30, and above the base 20, a stronger mechanical and electrical connection may be created. Also, the twisting of the housing 30 and base 20 is much easier and safer because of improved mechanical leverage and also because contact is made with the base 20 and housing 30 rather than with the conductors 500. Since the conductors 500 do not connect until the conductors 500 are inserted in the electrical connector 10, the electrical connector 10 reduces or eliminates exposing the technician to the possibility of sparking, electrical shock, short circuit or other electrical hazard. The electrical connector 10 provides excellent engagement in a faster way, while minimizing the risks of electrical hazard.

Optional wing(s) 60 and gripper ridge(s) 20 permits relatively easy twisting of the electrical connector 10 while providing a relatively high level of resistance from un-wrapping even if the conductors 500 are pulled apart. For example, the base partitions 20 may have pinch ends to prevent withdrawal of the conductor 500 to further resist un-wrapping. Assembly of the electrical connector 10 requires a relatively low level of insertion force compared to the extraction force, although the base 20 and housing 30 may be removed. Further, the relatively easy twisting of the housing 30 provides many ergonomic advantages. For example, the relatively low level of twisting force is particularly advantageous for crafts-personnel, such as technicians and assembly line operators who repetitively twist connectors. The relatively low level of twisting force required for making connections may result in fewer injuries to the crafts-personnel, including injuries related to repetitive stress syndrome. Further since the electrical connector 10 can adapt to different sizes of conductors 500, a single or reduced number of electrical connectors may be used during assembly or constriction. Thus, confusion during assembly or wiring is reduced or eliminated since the same type electrical connector may be used for all connections. Thus, an electrician need not worry about selecting the electrical connector for different slot thicknesses.

The relatively high level of resistance to reverse twisting, characteristic of the electrical connector, securely couples conductors. Further, the electrical connector 10, along with the optional coiled wire 800 and wrap wire 900 continuously adapts to changes in environmental conditions such as flexing, vibration and thermal expansion. For example, the electrical connector 10 may adapt to changes in thermal expansion, especially due to the differences in thermal expansion rates between dissimilar metals with respect to the conductors and/or between plastic components such as the base and housing. Yet another advantage is that the electrical connector 10 is relatively easy to manufacture using relatively inexpensive manufacturing processes and materials. The use of the electrical connector 10 decreases production costs, increases worker productivity and efficiency and decreases overall wiring costs. The electrical connector 10 may also connect to insulated (along with the optional stripper blade) and/or metal conductors. The electrical connector 10 may be made of anti-corrosive material such as plastic, rubber or treated metal to provide long reliable service life.

It is understood that the implementation of other variations and modifications of the present invention in its various aspects will be apparent to those of ordinary skill in the art and that the invention is not limited by the specific embodiments described. It is therefore contemplated to cover by the present invention any and all modifications, variations or equivalents that fall within the spirit and scope of the basic underlying principles disclosed and claimed herein.

The invention claimed is:

1. A pivoting electrical connector comprising:

a base having a cavity and base partitions operative to receive two or more conductors at an end of the base; and a housing operative to pivotally connect without ratcheting to said base and adapted to rotate about an axis of rotation to allow insertion of the two or more conductors into said cavity of the base in the same direction and to twist the conductors into electrical contact when the housing is pivoted, wherein the housing further includes at least one wing.

2. The pivoting electrical connector of claim 1, wherein the base and housing are pivotally connected by at least one of: a screw and thread, a grommet and grove, a bearing and channel.

3. The pivoting electrical connector of claim 1, wherein the base further includes a ridge adapted to rotate about a grove in the housing to permit insertion and removal of the base from the housing.

4. The pivoting electrical connector of claim 1, wherein the base further includes gripper ridges.

5. The pivoting electrical connector of claim 1, wherein the housing further includes one or more housing partitions to twist the conductors into electrical contact when the housing is pivoted.

6. The pivoting electrical connector of claim 1, wherein the housing partitions are tapered.

7. The pivoting electrical connector of claim 1, wherein the one or more partitions are formed in the housing and the housing partitions form the shape of: circles, triangles, rectangles, squares, or ovals.

8. The pivoting electrical connector of claim 1, wherein at least one of: the base and the housing are made of at least one of: a conductive and insulating material.

9. The pivoting electrical connector of claim 1, further comprising a pair of blade members capable of cutting through an outer insulation of said insulated conductors.

10. The pivoting electrical connector of claim 1, wherein at least one of: the base and the housing are made of at least one of: a translucent and transparent material.

11. A pivoting electrical connector comprising:

a base having a cavity;

base partitions operative to receive at least two conductors at an end of the base;

a slotted ridge formed along a circumference of an end of the base; and a housing;

a grooved rim formed along an end of the housing operative to pivotally connect without ratcheting to said base and adapted to rotate about an axis of rotation to allow insertion of at the least two conductors into said cavity and to twist the conductors into electrical contact when the housing is pivoted.

12. The pivoting electrical connector of claim 11, wherein the base further includes gripper ridges and the housing further includes at least one wing.

13. The pivoting electrical connector of claim 11, wherein the housing further includes one or more housing partitions to twist the conductors into electrical contact when the housing is pivoted.

14. The pivoting electrical connector of claim 13, wherein the one or more housing partitions are tapered.

15. The pivoting electrical connector of claim 13, wherein the one or more partitions are formed in the housing and the housing partitions form the shape of: circles, triangles, rectangles, squares, or ovals.

16. The pivoting electrical connector of claim 11, wherein at least one of: the base and the housing are made of at least one of: a conductive and insulating material.

17. The pivoting electrical connector of claim 11, further comprising a pair of electrically conducting blade members capable of cutting through an outer insulation of said insulated conductors.

18. An electrical connector assembly:

an electrical terminal;

at least one pivoting electrical connector comprising:

a base having a cavity and base partitions to receive at least two conductors at an end of the base; and a housing operative to pivotally connect without ratcheting to said base and adapted to rotate about an axis of rotation to allow insertion of the at least two conductors into said cavity and to twist the conductors into electrical contact when the housing is pivoted, wherein the housing further includes at least one wing.

19. The electrical assembly of claim 18, wherein the base further includes a base coupler and the housing further includes a housing coupler to pivotally connect the housing to the base.

20. The pivoting electrical connector of claim 1, wherein the two or more conductors bend toward each other as the conductors are inserted into a conical end of the housing.

* * * * *